US007441517B2

(12) United States Patent
Iaffrate et al.

(10) Patent No.: US 7,441,517 B2
(45) Date of Patent: Oct. 28, 2008

(54) COOLING CIRCUIT FOR A MOTOR VEHICLE AND CORRESPONDING MOTOR VEHICLE

(75) Inventors: Serge Iaffrate, Montmerle sur Saone (FR); Antonio Principato, Parcieux (FR); Dominique Vaginet, Saint Bernard (FR)

(73) Assignee: ITW Bailly Comte, Genay (FR)

( * ) Notice: Subject to any disclaimer, the term of this patent is extended or adjusted under 35 U.S.C. 154(b) by 476 days.

(21) Appl. No.: 10/546,044

(22) PCT Filed: Feb. 27, 2004

(86) PCT No.: PCT/FR2004/000456

§ 371 (c)(1),
(2), (4) Date: Aug. 17, 2005

(87) PCT Pub. No.: WO2004/077916

PCT Pub. Date: Sep. 16, 2004

(65) Prior Publication Data

US 2006/0090713 A1 May 4, 2006

(30) Foreign Application Priority Data

Feb. 27, 2003 (FR) ..... 03 02417

(51) Int. Cl.
*F01P 11/18* (2006.01)
*F01P 11/02* (2006.01)
*F01P 7/16* (2006.01)

(52) U.S. Cl. ..... 123/41.54; 123/41.27; 123/198 D

(58) Field of Classification Search ..... 123/41.54, 123/41.27, 198 D; 220/DIG. 32, 203.01, 220/203.09
See application file for complete search history.

(56) References Cited

U.S. PATENT DOCUMENTS

| | | | | |
|---|---|---|---|---|
| 4,489,883 | A * | 12/1984 | Anderson | 236/92 C |
| 4,995,452 | A * | 2/1991 | Franck et al. | 165/119 |
| 5,279,025 | A | 1/1994 | Kinast | |
| 6,056,139 | A | 5/2000 | Gericke | |
| 2002/0157621 | A1 | 10/2002 | Lefrancois et al. | |

FOREIGN PATENT DOCUMENTS

| | | |
|---|---|---|
| EP | 0 774 569 A1 | 5/1997 |
| SU | 1178916 A | 9/1985 |

* cited by examiner

*Primary Examiner*—Stephen K Cronin
*Assistant Examiner*—Arnold Castro
(74) *Attorney, Agent, or Firm*—Lowe, Hauptman, Ham & Berner, LLP

(57) ABSTRACT

The circuit includes an internal volume for receiving a cooling fluid, a stopper for selectively closing an opening giving access to the internal volume, and ensuring element that the cooling fluid can be discharged via a discharge outlet. The respective discharge and access openings to the internal volume are distinct from each other, and a flap valve, which is detachably fixed in relation to the stopper and which is moveable between respective closure and release positions of the access opening when the flap valve is disconnected from the stopper, is also provided. The flap valve exclusively moves from its closed position when the pressure prevailing inside the internal volume is lower than a predefined pressure value.

13 Claims, 4 Drawing Sheets

COOLING CIRCUIT FOR A MOTOR VEHICLE AND CORRESPONDING MOTOR VEHICLE

RELATED APPLICATIONS

The present application is based on International Application No. PCT/FR2004/000456 filed Feb. 27, 2004, and claims priority from, French Application No. 03 02417filed Feb. 27, 2003, the disclosure of which is hereby incorporated by reference herein in its entirety.

FIELD OF THE INVENTION

The present invention relates to a cooling circuit for a motor vehicle, as well as to a motor vehicle provided with such a cooling circuit.

A cooling circuit conventionally comprises different pipes, also called hose connections, which extend in the vicinity of the motor and the radiator of the motor vehicle. In addition, a member allowing selective access to the internal volume of this circuit is provided, in order that a user may periodically proceed with an addition of cooling liquid.

BACKGROUND OF THE INVENTION

It is known to make the afore-mentioned member in the form of a stopper, which is mobile between respective positions of closure and of access to this internal volume. To that end, the stopper is fixed on the body of the cooling circuit, for example by screwing or by means of a rapid fixation, of the "quarter-turn" type.

In addition, this stopper is provided with a flap valve allowing discharge of air and of water, out of the cooling circuit, when the pressure of cooling liquid attains an abnormally high value, particularly in the case of overheating. It also comprises an additional flap valve allowing the admission of air, by depression, in the cooling circuit.

However, this known solution involves certain drawbacks, in particular in terms of safety for the user.

In effect, the afore-mentioned stopper proves to be particularly dangerous for the driver, when he/she proceeds with opening the stopper, while the cooling liquid is still at a high temperature. There is in that case a considerable risk of projection of hot liquid, which is expelled from the cooling circuit in the direction of the driver, under the effect of the pressure.

This being specified, the invention proposes to produce a cooling circuit allowing the different drawbacks of the prior art set forth hereinabove to be overcome.

To that end, it has for its object -a cooling circuit for motor vehicle, particularly for motor vehicle with internal combustion, presenting a body comprising at least one pipe intended to extend in the vicinity of the motor and of the radiator of said vehicle, this body presenting an internal volume for receiving a cooling fluid, this circuit also comprising a stopper for selectively closing an opening giving access to this internal volume, this stopper being removably fixed on the body, as well as means ensuring discharge of said cooling fluid, particularly in the case of over-pressure, via a discharge outlet, characterized in that the respective openings for discharge and for access to the internal volume are distinct and in that a flap valve is provided, removably fixed on the stopper, this flap valve being mobile, when it is disconnected with respect to the stopper, between respective closure and release positions of the access opening, this flap valve being adapted to leave its position of closure only when the pressure prevailing in the internal volume becomes lower than a predetermined pressure.

SUMMARY OF THE INVENTION

According to other characteristics of the invention:

- the predetermined pressure is close to the atmospheric pressure, in particular slightly higher than the latter.
- the body of the cooling circuit comprises means for supporting the valve, in its position of release.
- the body of the cooling circuit comprises abutment means, adapted to oppose a movement of translation of the flap valve, in particular upward, so as to disconnect this valve with respect to the stopper.
- the stopper comprises a body adapted to be connected, particularly by screwing, on the body of the cooling circuit, as well as a shell for a user to grip, which is disengageable with respect to the body of the stopper.
- the stopper is provided with a skirt, adapted to be introduced inside a neck of the cooling circuit, sealing means being imprisoned between the opposite walls of this skirt and this neck.
- the means for removably fixing the flap valve on the stopper are means for fixation by elastic clipping, particularly a stud belonging to the stopper, adapted to be fixed by elastic clipping in a bottom of the valve.
- the discharge means comprise a discharge valve adapted to close the discharge outlet selectively.
- the discharge outlet is adapted to direct the cooling fluid expelled from said internal volume substantially downwardly.
- an orifice is in addition provided, for placing the internal volume at atmospheric pressure, which is distinct from the discharge outlet and the access opening.
- the body of the cooling circuit comprises an expansion tank, the access opening being provided in the upper part of this expansion tank, while the discharge outlet is provided below this expansion tank.
- the orifice for placing at atmospheric pressure is provided at the apex of the expansion tank, next to the access opening.

The invention also has for its object a motor vehicle, particularly with internal combustion, which is provided with a cooling circuit as defined hereinabove.

BRIEF DESCRIPTION OF THE DRAWING

The invention will be described hereinafter with reference to the accompanying drawings, given solely by way of non-limiting example, in which.

DETAILED DESCRIPTION OF THE INVENTION

Figure 1:
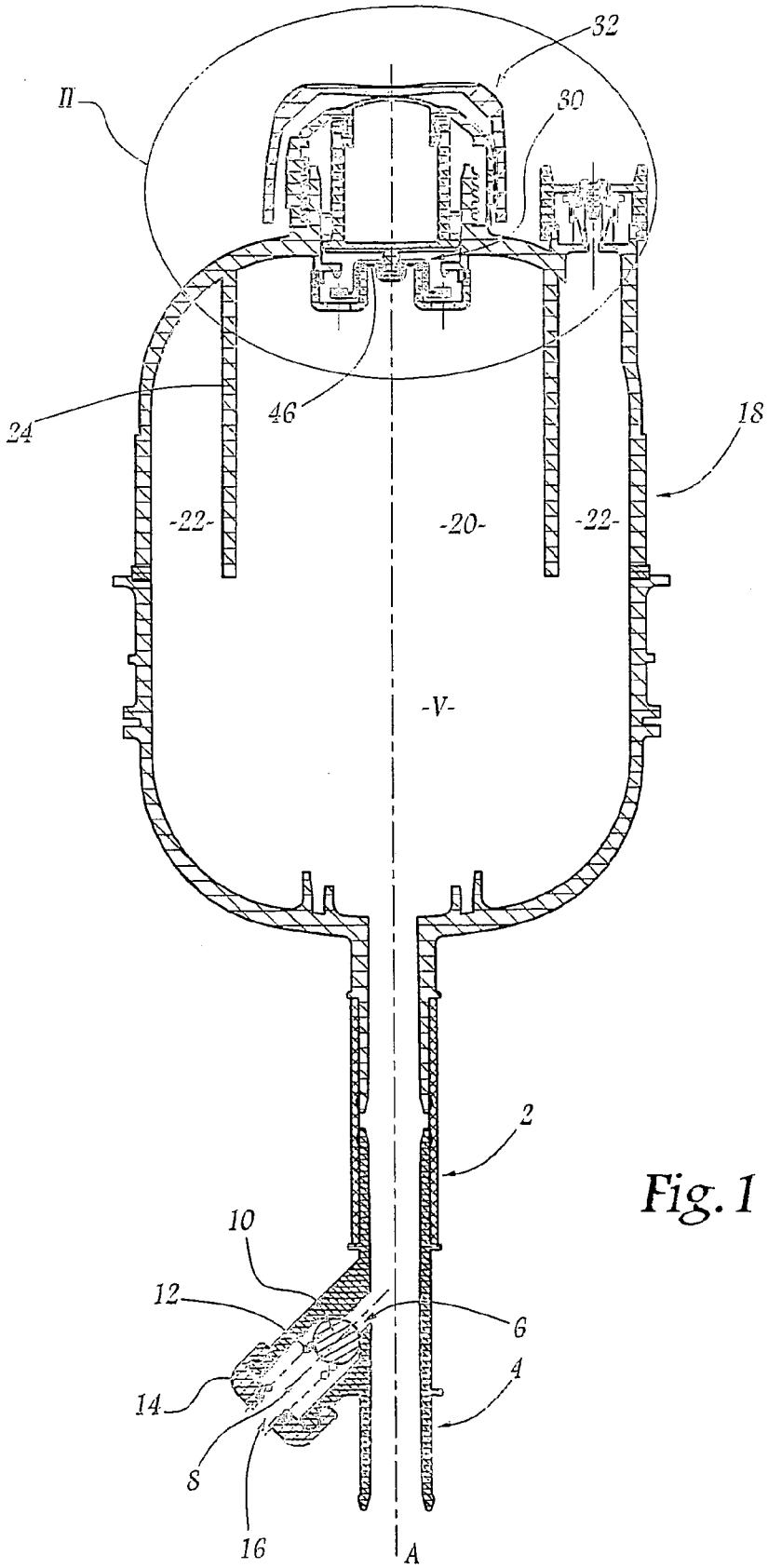
FIG. 1 is a view in longitudinal section of a cooling circuit according to the invention.

The cooling circuit, partially illustrated in FIG. 1, conventionally comprises a plurality of pipes, or hose connection, of which only one is shown in this FIG. 1, where it is given reference 2. These different hose connections conventionally extend in the vicinity of the engine and of the radiator of a motor vehicle, which have not been shown.

A connection 4, coaxial to the hose connection 2, is inserted at the end of this latter. It has a lateral outlet 6 made therein, intended for the discharge of the fluid admitted in the cooling circuit, as will be seen hereinafter.

This outlet 6 opens out in a housing 8, within which a flap valve 10 is received, adapted to selectively close the afore-mentioned outlet 6. This flap valve is mounted against a spring 12, abutting by one of its ends against a stopper 14, which has an orifice 16 made therein allowing the housing 8 to be placed in communication with the atmosphere.

It should be noted that the housing 8 extends obliquely, globally downwardly. Consequently, as will be seen more precisely in the following, this makes it possible to give the fluid possibly escaping from the cooling circuit a descending direction.

The hose connection 2 is connected to an expansion tank 18, of type known per se, which presents a vertical major axis, denoted A. This tank 18 is divided, in its upper part, into a principal chamber 20 and a peripheral chamber 22, which are separated by a vertical annular wall 24.

At its upper end, opposite the hose connection 2, the expansion tank 18 is provided with a threaded neck 26. Moreover, in the vicinity of the walls of this neck, a re-entrant peripheral flange 28 is provided, defining an opening 30 allowing access to the internal volume V of the expansion tank.

The expansion tank 18 is in addition capped by a stopper, generally designated by reference 32. The latter comprises a tapped body 34, intended to cooperate with the threaded neck 26, as well as an outer shell 36 ensuring grip by a user.

The body 34 and the shell 36 are such that they give the screwing of the stopper 32 on the neck 26 a disengageable character. This means that, prior to the movement of rotation allowing unscrewing of the stopper, the user must proceed with a complementary movement, in the present case press downwardly on the shell 36.

This disengageable character, of type known per se, may, however, be assured differently, in particular by providing that the user must pinch the shell 36 against the body 34, before proceeding with the afore-mentioned unscrewing.

The stopper 32 is provided with a skirt 38, presenting a closed bottom 40, which is provided with a stud 42, whose function will be explained in the following. An O-ring 44 is, furthermore, imprisoned between the opposite faces of the neck 26 and of the skirt 38.

A flap valve 46 is also provided, comprising a web 48, extended by a lateral wall 50, which is itself terminated by an outer flange 52. This flap valve 46 is removably fixed to the stopper 32 by any appropriate means, in the present case by elastic clipping of the web 48 on the stud 42.

The lateral wall 50 and the flange 52 of the flap valve 46 are received in a housing 54, defined by an annular piece 56, which is fixed on the body of the expansion tank, in the vicinity of the flange 28. This annular piece 56 has a slot 58 made therein, allowing the internal volume V to be placed in communication with the access opening 30.

The peripheral chamber 22 is placed in communication, at its upper end, with an opening 60 defined by a re-entrant flange 62. Above the latter is provided a stopper 64, having an orifice 66 made therein, intended for placing the internal volume V at atmospheric pressure, as will be seen hereinafter.

This stopper is equipped with a valve 68, which selectively closes the orifice 66. The latter is mounted against a spring 70, of which one end abuts against the afore-mentioned flange 62.

Figure 2:
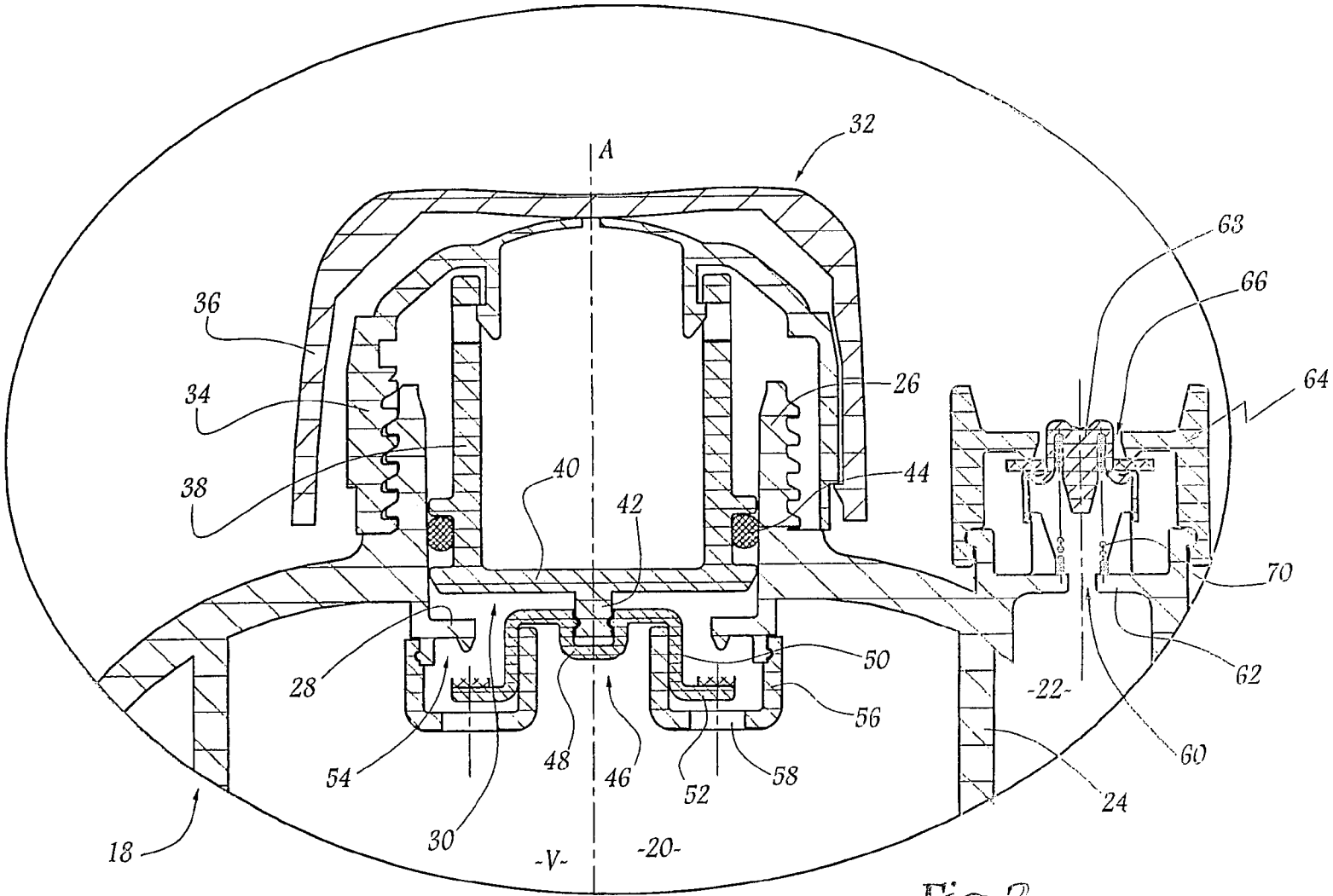
FIG. 2 is a view in section, on a larger scale, illustrating in isolated manner the stopper of the cooling circuit of FIG. 1, in a position of normal service.

FIGS. 1 and 2 illustrate the cooling circuit in a state of normal functioning. In this configuration, the flap valve 10 obturates the discharge outlet 6, while valve 68 obturates the orifice 66 for placing at atmospheric pressure and the principal stopper 32 is screwed on the neck 26.

Figure 3:
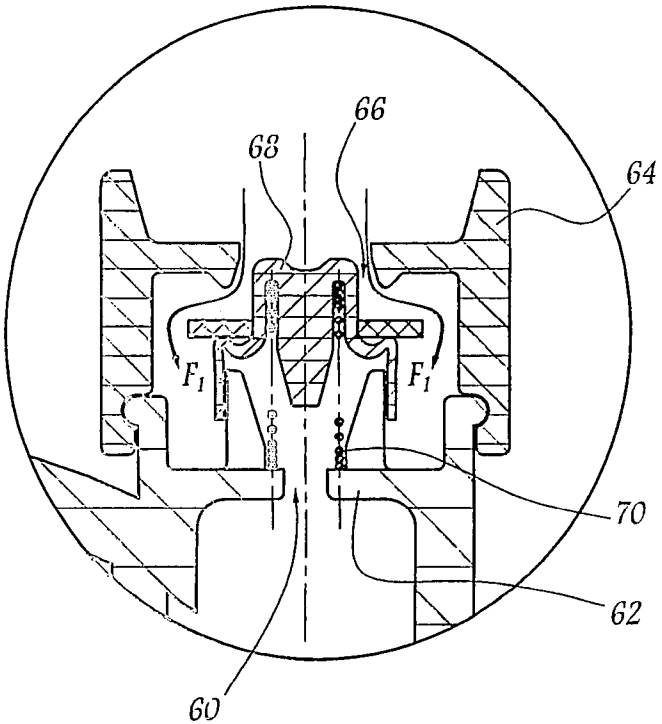
FIG. 3 is a view in section, on a larger scale, illustrating in isolated manner means for admission of air, by depression, with which the cooling circuit of FIG. 1 is provided.

When the internal volume V of the expansion tank 18 is at a pressure clearly less than atmospheric pressure, the valve 68 tends to move away from its seat, formed on the stopper 64. This then releases the orifice 66, with the result that outside air can penetrate in the direction of the internal volume V, in the direction of arrows $F_1$ in FIG. 3, this inducing an increase in the internal pressure of the cooling circuit.

It should be noted that the presence of this valve 68 may also allow the filling of the cooling circuit by a professional, via the orifice 66. This is advantageous, in terms of simplicity and rapidity, for the manufacturer who can fill the cooling circuit without removing the stopper 32.

When the fluid admitted into the cooling circuit heats abnormally, the driver of the vehicle is warned, for example by the activation of a luminous signal. Such increase in temperature is accompanied by a corresponding rise in pressure of this fluid.

In the case of the user deciding to remove the stopper in order to add cooling liquid, he must firstly press downwardly on the shell 36, before the operation of unscrewing proper. This therefore provides the cooling circuit of the invention with a first degree of safety.

Then, as this screwing takes place, the skirt 38 of the stopper 32 rises, opposite the body of the expansion tank 18. At a certain moment of this movement, the flange 52 of the valve 46 comes into abutment against the flange 28, provided on the expansion tank 18, with the result that it is no longer shown in this Figure.

Figure 4:
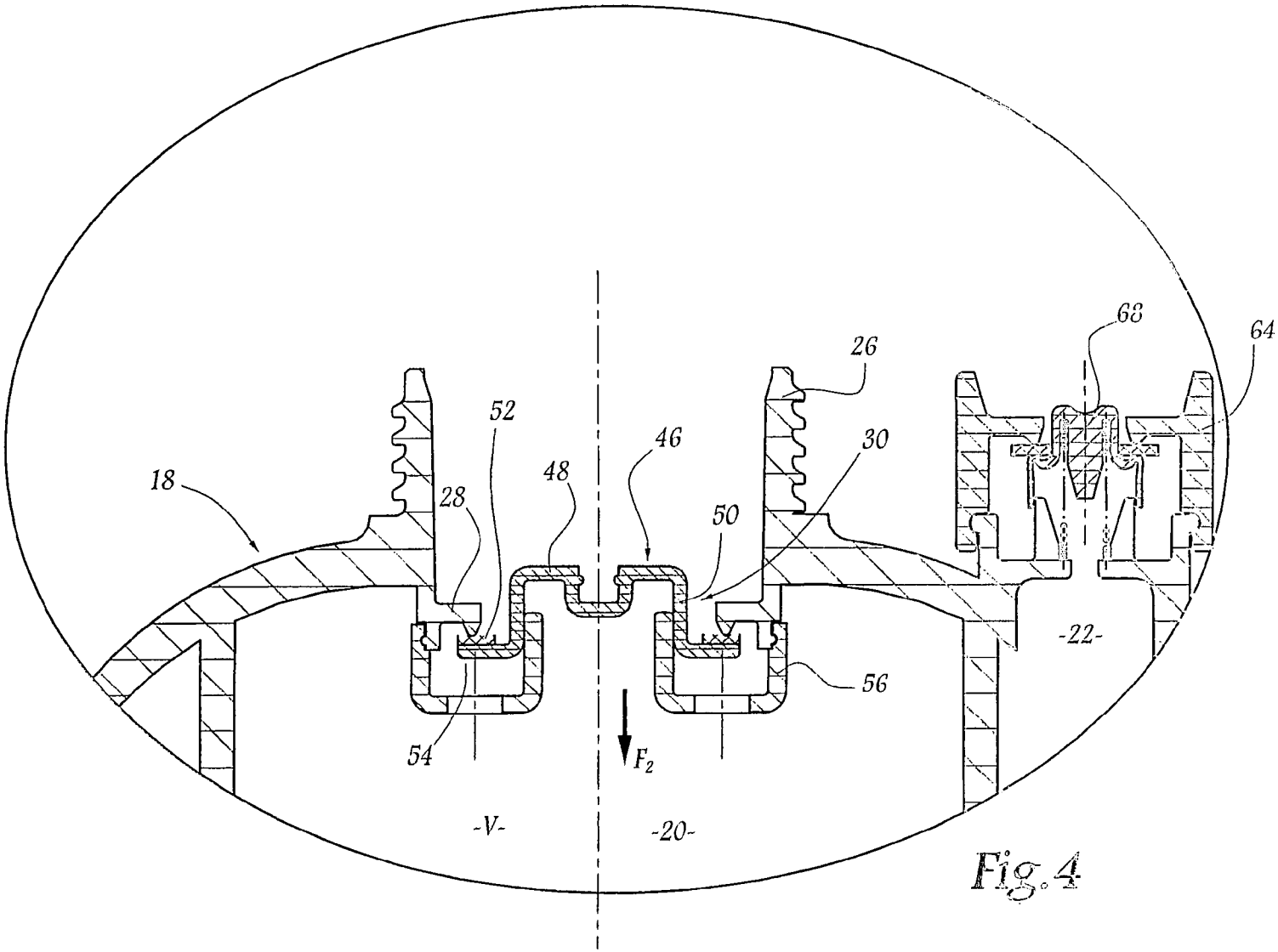
FIG. 4 is a view in section, similar to FIG. 2, partially illustrating the cooling circuit, after its stopper has been removed.

Consequently, if the user continues to unscrew the stopper, the valve 46 is disconnected from the skirt 38, being given that its web 48 is no longer engaged with the stud 42. This situation is thus illustrated in FIG. 4, where the stopper 32 is removed from the expansion tank 18, so that it is no longer shown in this Figure.

In this figuration, if the pressure prevailing in the internal volume V remains high, the valve is maintained against the flange 28, precisely under the effect of this pressure. This valve 46 therefore occupies a position of closure of the opening 30, allowing access to the internal volume V.

On the other hand, when the internal pressure of the expansion tank redescends below a predetermined value, which is close to atmospheric pressure, in the present case slightly higher than the latter, the valve 46 tends to redescend under the effect of gravity (arrow $F_2$). It then resumes its position of FIGS. 1 and 2, which allows the user to access the internal volume V, for example with a view to adding cooling liquid.

At the end of its descending movement, the valve 46, which henceforth occupies a position of release of the opening 30, rests in abutment against the annular piece 56.

It should be emphasized that the predetermined value of pressure below which the valve leaves its position of closure of the opening 30, may be different from the one set forth hereinabove. Means, for example elastic ones, may thus be provided, which oppose the displacement of this valve in one or the other direction.

It should be noted that, being given that the valve leaves its position of closure only when the pressure redescends, this guarantees that the internal volume V is not accessible to the user in the event of too high a pressure. This therefore makes it possible to overcome any risk of projection of liquid in the direction of the user, which would be due to an excess pressure.

Furthermore, upon an abnormally high rise in pressure of the cooling liquid, the valve 10 is pushed opposite its seat, this releasing the discharge outlet 6. Consequently, the overheated liquid is expelled from the cooling circuit via this outlet.

Figure 5:
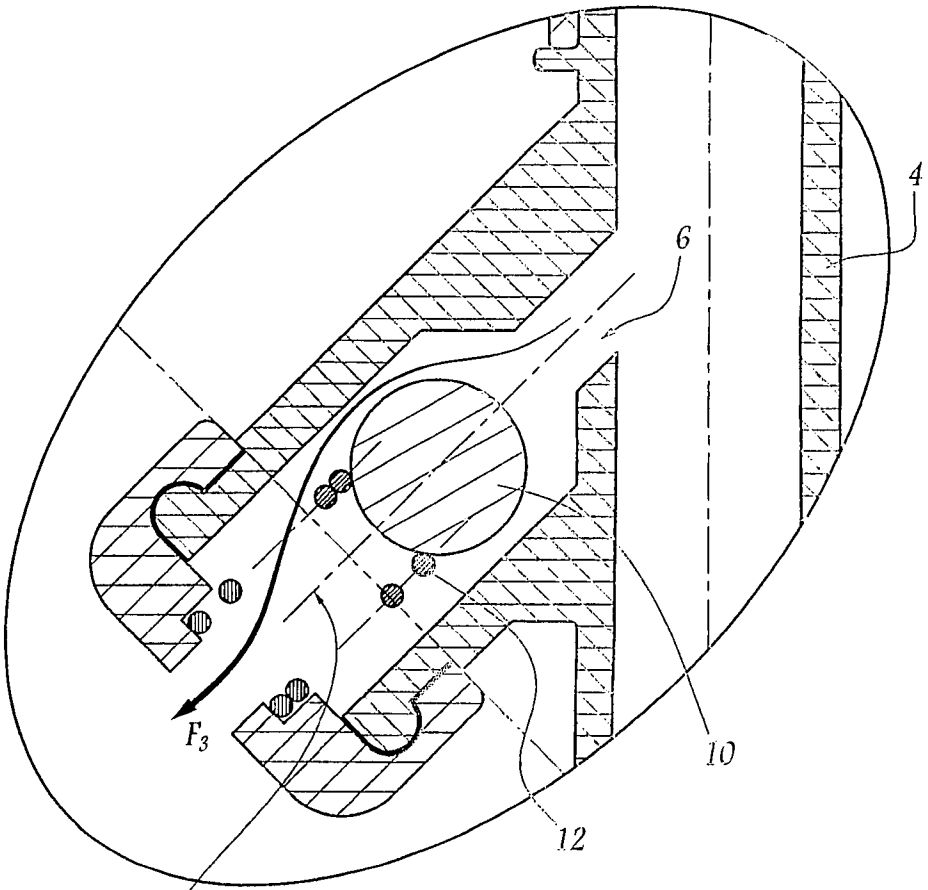
FIG. 5 is a view in section, on a larger scale, illustrating in isolated manner discharge means with which the cooling circuit of FIG. 1 is provided.

Being given the arrangement of the latter, this liquid is directed downwardly, for example towards the ground, in the direction of arrow $F_3$ in FIG. 5. Consequently, this phenomenon is not likely to be detrimental to the driver's physical integrity.

The invention is not limited to the example described and shown.

For example, the valve 68 for placing at atmospheric pressure can in particular be integrated in the stopper 32. Moreover, the valve 10 may for example be provided on the body of the expansion tank 18.

The invention makes it possible to attain the objects mentioned hereinabove.

For example, according to the invention, the respective outlets and openings for discharge and access to the internal volume are distinct. This therefore makes it possible to obturate the access opening by means of a stopper, this presenting a first degree of safety for the user. Furthermore, it is possible to arrange the discharge outlet so that the fluid possibly expelled from the cooling circuit is not directed towards the user.

Furthermore, the presence of the valve 46, which allows access to the internal volume only when the pressure redescends to below a threshold value, gives an additional degree of safety to the cooling circuit of the invention. In effect, thanks to this measure, the user cannot proceed with an addition of cooling liquid when the internal pressure is capable of harming his physical integrity.

Finally, it should be noted that the principal stopper 32, provided with a tapped body, may be adapted on already existent cooling circuits. This is particularly advantageous, in particular in terms of economy.

The invention claimed is:

1. A cooling circuit for a motor vehicle with an internal combustion engine, comprising a body having at least one pipe adapted to extend in the vicinity of the engine and of the radiator of said vehicle, said body defining an internal volume for receiving a cooling fluid, said circuit also comprising a stopper for selectively closing an opening giving access to this internal volume, said stopper being removably fixed on the body, as well as an element for ensuring discharge of said cooling fluid via a discharge outlet, wherein the access opening for access to the internal volume and the discharge outlet are distinct and a flap valve is removably fixed on the stopper, said flap valve being movable, when disconnected from the stopper, between respective closure and release positions of the access opening, said flap valve being adapted to leave the closure position only when the pressure in the internal volume becomes lower than a predetermined pressure.

2. The circuit according to claim 1, wherein the predetermined pressure is close to the atmospheric pressure.

3. The circuit according to claim 1, wherein the body of the cooling circuit comprises supporting elements that support the valve in the release position.

4. The circuit according to claim 1, wherein the body of the cooling circuit comprises an abutment element, stet to oppose an upward movement of the flap valve, so as to disconnect the flap valve from the stopper.

5. The circuit according to claim 1, wherein the stopper comprises a body connected to the body of the cooling circuit, as well as a shell for a user to grip, which is disengageable from the body of the stopper.

6. The circuit according to claim 1, wherein the stopper is provided with a skirt, introduced inside a neck of the body of the cooling circuit, and a sealing element being imprisoned between the opposite walls of said skirt and said neck.

7. The circuit according to claim 1, wherein the stopper has a stud adapted to be fixed by elastic clipping in a bottom of the valve.

8. The circuit according to claim 1, further comprising a discharge valve adapted to close the discharge outlet selectively.

9. The circuit according to claim 8, wherein the discharge outlet is adapted to direct the cooling fluid expelled from said internal volume downwardly.

10. The circuit according to claim 1, further comprising an orifice for placing the internal volume at the atmospheric pressure, which orifice is distinct from the discharge outlet and the access opening.

11. The circuit according to claim 1, wherein the body of the cooling circuit further comprises an expansion tank, the access opening being provided in the upper part of said expansion tank, while the discharge outlet is provided below said expansion tank.

12. The circuit according to claim 11, further comprising an orifice for placing the internal volume at the atmospheric pressure, wherein the orifice is distinct from the discharge outlet and the access opening and is provided at the apex of the expansion tank, next to the access opening.

13. A motor vehicle, comprising an internal combustion engine, and a cooling circuit according to claim 1.

* * * * *